United States Patent [19]

Schuler et al.

[11] Patent Number: 5,001,916

[45] Date of Patent: Mar. 26, 1991

[54] METHOD FOR THE CALIBRATED CROSS-SECTION REDUCTION OF A WORKPIECE ROTATING DURING SUCH METHOD.

[75] Inventors: Werner Schuler; Daniel Deriaz, both of Meilen, Switzerland

[73] Assignee: Ernst GROB AG, Mannedorf, Switzerland

[21] Appl. No.: 406,323

[22] Filed: Sep. 11, 1989

[30] Foreign Application Priority Data

Oct. 5, 1988 [CH] Switzerland ..... 03708/88

[51] Int. Cl.[5] ..... B21B 13/20

[52] U.S. Cl. ..... 72/96; 72/100

[58] Field of Search ..... 72/95, 96, 100, 208

[56] References Cited

U.S. PATENT DOCUMENTS

| | | | |
|---|---|---|---|
| 1,499,534 | 7/1924 | Katzenmeyer | 72/95 |
| 3,422,518 | 1/1969 | French | 72/76 |
| 4,646,549 | 3/1987 | Saito et al. | 72/95 |

FOREIGN PATENT DOCUMENTS

| | | | |
|---|---|---|---|
| 3715393 | 2/1988 | Fed. Rep. of Germany | 72/96 |
| 658006 | 10/1986 | Switzerland . | |

*Primary Examiner*—Lowell A. Larson

*Attorney, Agent, or Firm*—Sandler, Greenblum & Bernstein

[57] ABSTRACT

Rolling tools are rotatably mounted in rotatably driven rolling heads such that they revolve in a planetary-like fashion while the rolling heads rotate. The rolling tools thus roll with blows or impacts upon the outer surface of the rotating workpiece which is advanced along its lengthwise axis. A diameter reduction of the workpiece occurs and the workpiece material is predominantly displaced in lengthwise direction. The workpiece is moved along its axis in the feed direction at an axial feed velocity of at least 3 millimeters for each workpiece revolution, and in the case of hollow workpieces preferably at least at 5 millimeters per workpiece revolution. Difficulties which otherwise arise for certain materials can thus be avoided, and also the production speed and quality can be increased. For hollow workpieces, undergoing internal profiling upon a mandrel, the workpiece which is advanced at high axial feed is preferably also cold rolled during its return feed or motion. The return feed should be at most equal to the magnitude of the forward feed but may be also around such order of magnitude.

6 Claims, 4 Drawing Sheets

METHOD FOR THE CALIBRATED CROSS-SECTION REDUCTION OF A WORKPIECE ROTATING DURING SUCH METHOD.

BACKGROUND OF THE INVENTION

The present invention relates to a new and improved method for the calibrational cross-sectional reduction of a workpiece which is in rotation during performance of the method.

Generally speaking, the method concerns the reduction of the cross-sectional area and the calibration of the outer diameter of a solid or hollow workpiece by cold forming or cold rolling, during which time the workpiece is axially advanced or fed along its workpiece axis or lengthwise axis and rotated about its workpiece axis, while the outer surface of the workpiece is machined by rolling tools at least at two locations which are situated opposite one another with respect to the workpiece axis. The rolling tools are rotatably mounted in two respective rolling heads each rotatably driven to rotate about a rolling head axis which is disposed transverse to the workpiece axis. The rolling heads move the rolling tools in a planetary-like revolving path of motion or travel. The rolling tools, by exerting a rapid sequence of blows or impacts, cold form or cold roll the outer surface of the workpiece such that the cold rolling operations which occur in succession at least predominately in the direction of the workpiece axis overlap in the workpiece-axial direction and in the workpiece circumferential direction and bring about a displacement of material which predominately occurs in the workpiece axial direction.

It is here mentioned that, for instance, for so-called torsion bars or rods which are used for very many different technical fields of application, such as for instance as resilient or spring rods, drive shafts and the like, apart from thicker portions also require thinner portions. Furthermore, for well known reasons there cannot be present any steps or step portions, rather there are required gradual transitions at the location of changes in diameter.

As a general rule, such torsion bars or rods are machined on a lathe such that they do not exhibit any imbalance or their properties otherwise do not exhibit any unfavorably influencing irregularities which could arise during their previous fabrication, for instance during forging. The machine lathing of such slim long parts is well known to be problematic, and the tool service life and working speeds are rather modest with the required hard materials. The cutting or removal of the material automatically leads to losses in material. There are required relatively large workpiece diameters. Also relatively great hardening distortions become problematic.

These drawbacks are avoided with the method disclosed in the commonly assigned Swiss Patent No. 658,006, granted Oct. 15, 1986 and which has been briefly set forth at the introduction of this disclosure. The reduction in the cross-sectional area is precisely accomplished by cold forming or cold rolling, that is to say by carrying out a cold impact rolling operation during which there cannot only be realized exceedingly high working speeds, but there can be complied with the purposes of the invention. The tool service life is very high without impairing the precision. High operating speeds allow for a material flow with at least in many cases permanent, i.e. through-going plastification, resulting in a much more extensive or deep reaching material strength. If a subsequent hardening operation is needed then there is only to be expected a modest hardening distortion. This constitutes a further advantage in contrast to machine turned or lathed parts. Since as a practical manner there are only machined rotating and uniformly driven parts the mass forces can be held within acceptable limits. Furthermore, there can be also easily avoided the oscillations or vibrations which are problematic during machine lathing.

If solid or hollow workpieces, for instance torsion rods or bars, were fabricated according to the method disclosed in the aforementioned Swiss Patent No. 658,006, there sometimes arose unexpected difficulties even when working with materials which were satisfactory for the intended purpose.

As to such difficulties, it is pointed out that in certain instances there could arise an insufficient plastification or plasticizing, whereas in other instances there was discerned a too pronounced increase in strength. In both cases the material flow was unsatisfactory and, in fact, there arose the danger of fracture.

Moreover, in the case of hollow, in other words tubular-like workpieces it sometimes was found that there existed an insufficient radial material flow. This possibly could lead to a poor forming or shaping of the internal profile. In order to improve the formation of the internal profile experience found it to be appropriate for the rolling heads to be more markedly advanced or infed. When there was finally attained a sufficient forming or shaping of the inner or internal profile, it was found that in certain instances the wall thickness was too thin.

In those instances no improvement could be attained by increasing the machining operation, in other words by increasing the density of the cold rolling operations.

SUMMARY OF THE INVENTION

Therefore, with the foregoing in mind it is a primary object of the present invention to provide an improved method of the aforementioned type which is not afflicted with the drawbacks and limitations of the prior art.

Another and more specific object of the present invention aims at avoiding these drawbacks and providing a teaching as to how the initially discussed known cold forming or rolling method also can be rendered economically useful in those fields of application where it was previously unsatisfactory.

Now in order to implement these and still further objects of the invention, which will become more readily apparent as the description proceeds, the method of the present development, among other things, is manifested by the features that the workpiece, related to its machining or cold forming thereof with two rolling tools, each of which revolves in one of two rolling heads, is advanced with an axial workpiece feed of at least 3 millimeters for each workpiece revolution.

It has been surprisingly found during numerous trials or tests that the feared errors did not arise when the workpiece was fed or advanced with an axial feed amounting to at least 3 millimeters per workpiece revolution, resulting in a very low local machining density.

As a general rule, the possibly arising wave-like or undulatory outer surface was not found to be disadvantageous.

In the case of hollow profiles, it is possible according to the inventive method of the just mentioned type, to obtain a good cold forming operation if the hollow workpiece, considered in relation to cold forming or rolling with two rolling tools, each of which revolves in one of two rolling heads, is advanced or fed with an axial workpiece feed of at least 5 millimeters per workpiece revolution.

If the inventive method of the aforementioned particular character is employed for the reduction of the cross-sectional area and calibration of the outer diameter of a hollow workpiece which is located upon a profiled mandrel, there is attained an outstanding formation or construction of the thus produced internal or inner profile in the workpiece. However, sometimes it is not possible to avoid that following the removal of the workpiece from the mandrel there becomes manifest a certain rotation or turning of the profile.

The measures which were heretofore conventional in order to avoid such rotation or turning are well known to be cumbersome and expensive.

This drawback can now be unexpectedly simply counteracted according to a particular embodiment of the inventive method in that the workpiece, after it has been machined during the course of the aforementioned axial feed or advance, is again cold rolled in analogous fashion during an axial return feed or movement of the workpiece opposite to the direction of the axial feed of the workpiece. The rolling heads are at most slightly more intensely advanced towards the lengthwise axis of the workpiece or else remain at the same setting. Furthermore, the axial return feed of the workpiece is more or less similar to the order of magnitude or the forward feed or at most maintained at the same order of magnitude as the axial feed the workpiece which previously was accomplished in the opposite direction.

So to speak as a side benefit there is smoothed the wave-like outer surface which results during the very high axial feeds during the first rolling operation. It has already been explained that during the first rolling operation during the forward feed the low local machining density results in unexpectedly good results.

Naturally during the second rolling operation during the return feed the local machining density is appreciably increased, for instance doubled, so that there had to be expected the renewed occurrence of the fault.

However, the quasi doubling of the local machining density again, unexpectedly, brings about, instead of an occurrence of the feared error in fact a correction of the internal profile and a smoothing of the outer surface. This is in addition to the advantages which can be attained with the first working operation.

The "correction" of the turning or rotation which can be obtained during rolling with axial return feed is, as a general rule, that much greater the greater the axial return feed.

With the inventive method there can be realized all of the measures or advantages which have been enumerated in the aforementioned Swiss Patent No. 658,006. Consequently, for brevity in the description the disclosure of such patent is not repeated, rather the same is fully incorporated herein as an integrated part of the present description. As has already been explained in the aforementioned Swiss Patent No. 658,006, extremely high working speeds are possible which render the rolling operation quicker than the heretofore conventional machine lathing or turning operation. According to the present invention, this advantage is even more pronounced because the lower local machining density owing to the markedly increased axial feed, renders possible a still higher working speed. Just as was heretofore the case there is avoided the undesired oscillations or vibrations of the machine lathing operation and also there can be obtained a useful calibration. The deeply penetrating structural improvement, which already was discernible with the conventional machining density (with the feed there was of course increased the rotational speed of the rolling heads), is even further improved according to the invention although with the lower local machining densities there was expected an impairment of the material flow.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

Figure 2:
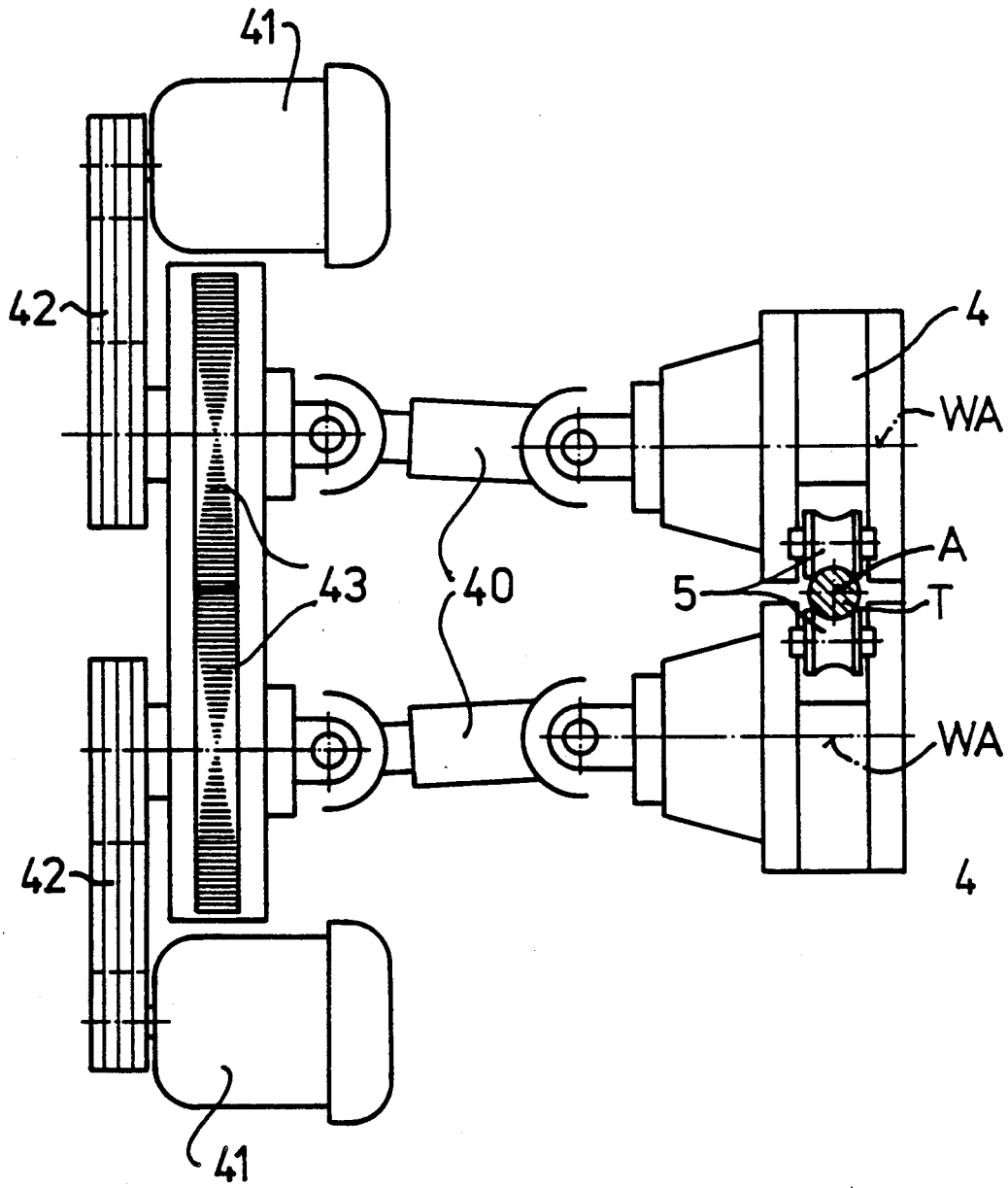
FIG. 2 is an enlarged front view, in relation to the showing of FIG. 1, of the rolling head drive looking in the direction of the arrow II of FIG. 1.
Figure 4:
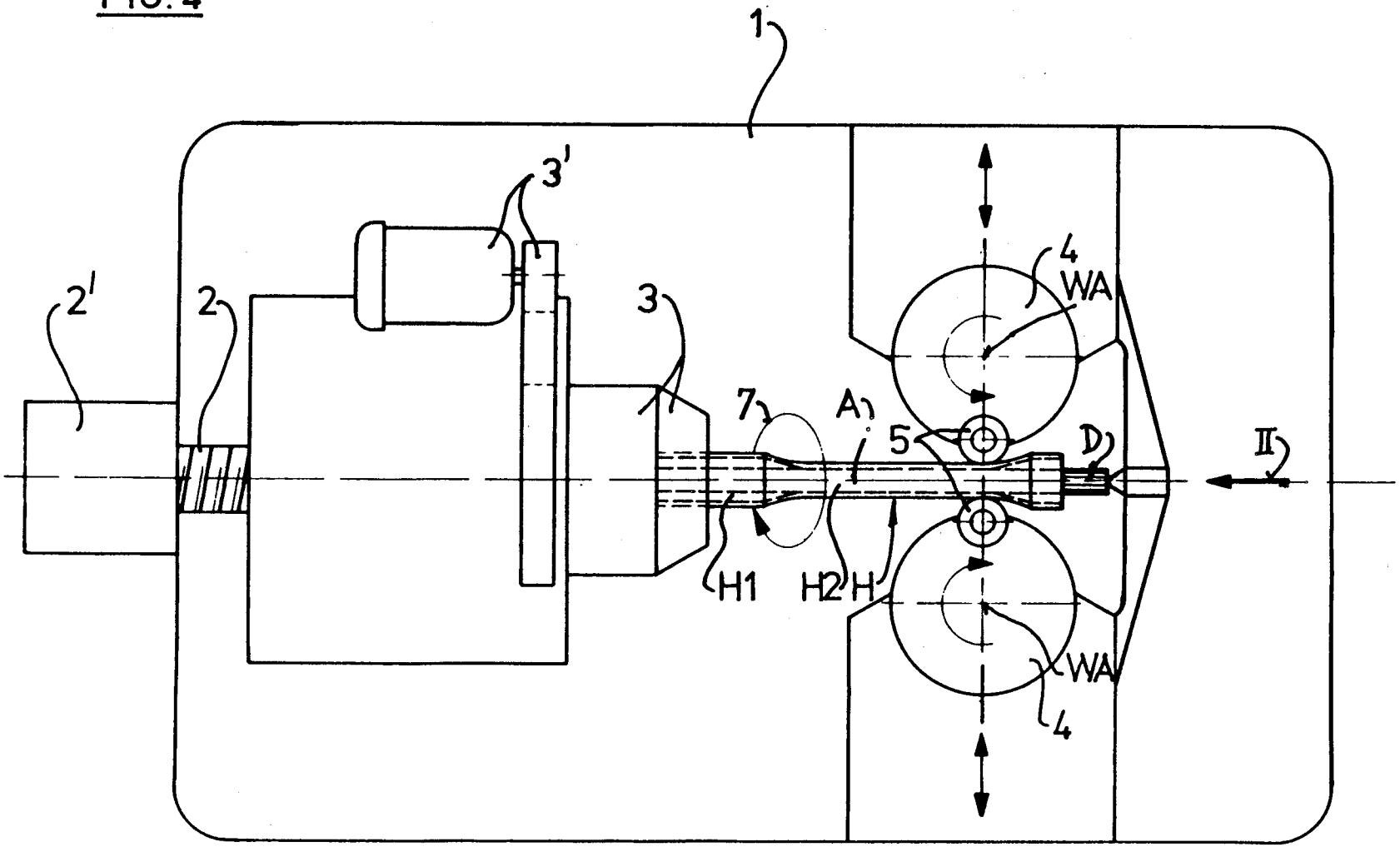
FIG. 4 is a top plan view of the apparatus already depicted in FIG. 1 showing a somewhat modified workpiece holding or supporting arrangement in which a hollow rod or bar, in other words a tube is machined according to the inventive method upon a profiled mandrel.

(The view of the rolling tool drive of the device depicted in FIG. 4 corresponds to FIG. 2; the single difference resides in the fact that instead of the workpiece T there would be illustrated the workpiece H upon the mandrel D, which for the given size relationships could not be made readily discernible. Therefore, it is believed to be of no value to again repeat the illustration of FIG. 2 and employ in place of the reference character T the reference characters H and D.)

Figure 5:
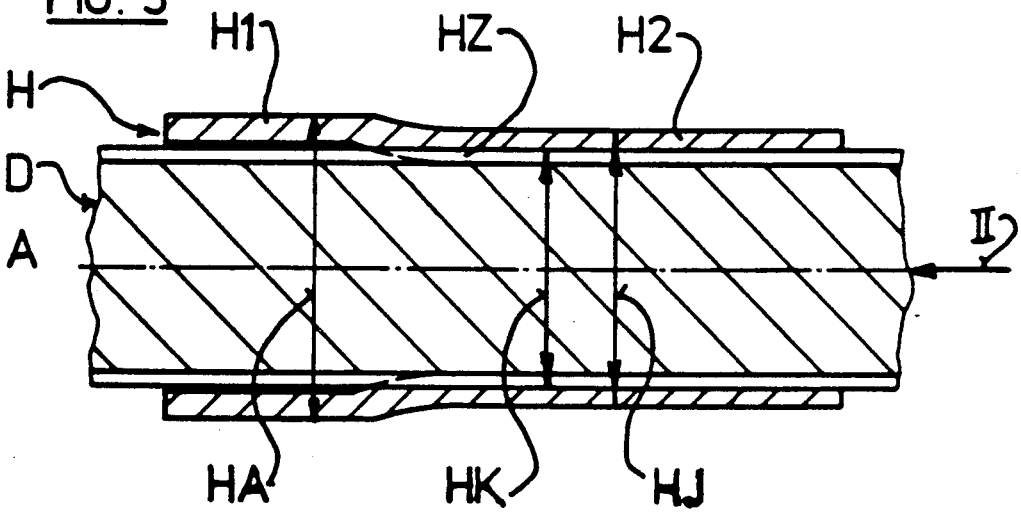
Figure 6:
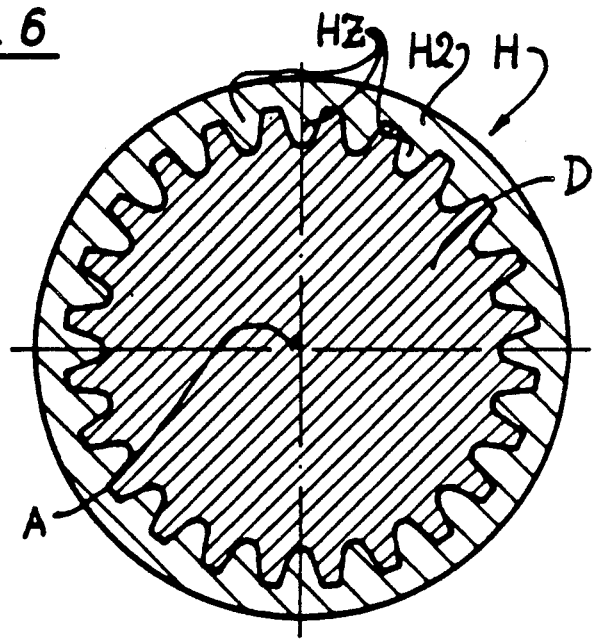

FIG. 5 is a fragmentary view of the workpiece H located upon the mandrel D and in an enlarged scale in relation to FIG. 4, both parts being shown in section along the lengthwise axis A; and FIG. 6 is a cross-sectional view through the workpiece H and the mandrel D on an enlarged scale in relation to the showing of FIG. 5.

DETAILED DESCRIPTION OF THE PREFERRED EMBODIMENTS

Before beginning an extensive discussion of the drawings there will now be first listed the various elements and reference characters depicted therein and their significance:

A workpiece lengthwise axis.

D mandrel.

T torsion rod or bar.

T1 thicker part of torsion bar T with outer diameter TA.

T2 smaller or reduced location of torsion bar T with outer diameter TJ.

TA original outer diameter of torsion bar T at the thicker part T1.

TJ smaller or reduced outer diameter of torsion bar T at location T2.
TD half difference between TA and TJ.
H hollow rod or bar.
H1 thicker location of hollow rod H with original outer diameter HA.
H2 smaller or reduced location of hollow rod H with outer diameter HJ.
HA original outer diameter of hollow rod H at thicker location H1.
HJ smaller or reduced outer diameter of hollow rod H at smaller location H2.
HK larger inner diameter at smaller location H2.
HZ teeth of hollow rod H at its internal toothing.
WA rolling head axes spaced from and transverse to workpiece axis A.
II arrow: extends in feed direction of torsion bar T and hollow rod H, and extends opposite to return feed direction of hollow rod H.
1 machine frame.
2 threaded spindle for the feed of chucking device 3 along the workpiece axis A.
2' motor drive of threaded spindle 2.
3 chucking device or chuck.
3' gearing motor for rotating chucking device 3 in the direction of the arrow 7.
4 rolling heads.
40 Cardan shafts, each for the drive of the rolling heads 4.
41 electric motors, each for the drive of the Cardan shafts 40.
42 belt drives, each connecting elements 40 and 41.
43 gears, each synchronizing the Cardan shafts 40.
5 rolling tools, one in each rolling head 4.
7 rotation direction of torsion bar T and hollow rod H.

Figure 1:
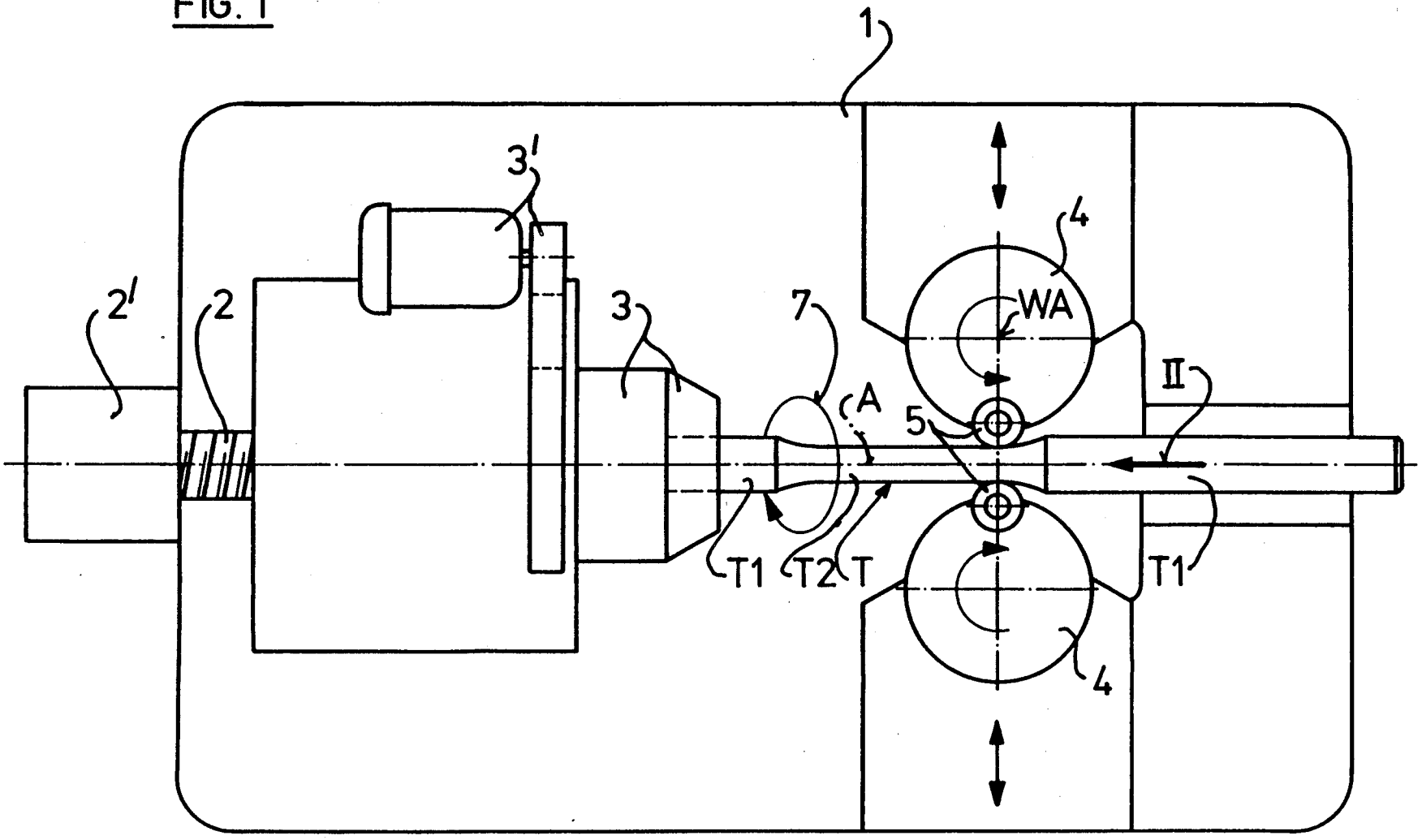
FIG. 1 is a top plan view of an apparatus in which a massive, in other words a solid bar or rod is machined according to the inventive method.
Figure 3:
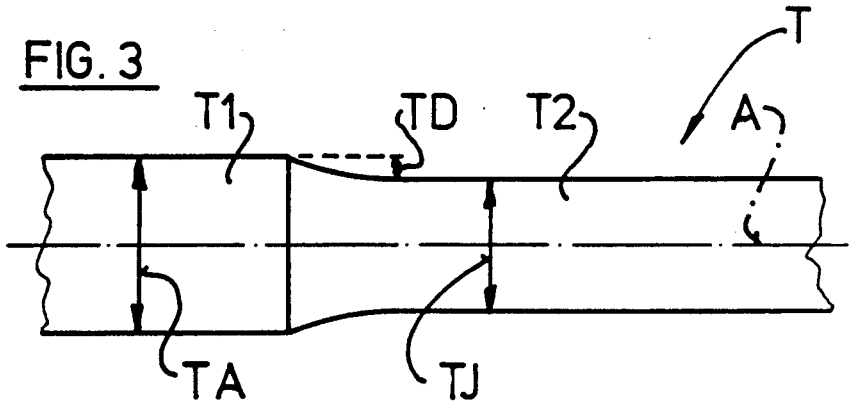
FIG. 3 is a fragmentary illustration of the workpiece or bar stock shown on an enlarged scale in relation to FIG. 1.

Turning attention now to FIGS. 1 to 3 of the drawings, it is to be understood that in FIGS. 1 and 2 there is illustrated an apparatus comprising a machine frame 1 in which there is rotatably mounted a chucking device or chuck 3 which is axially displaceable along the workpiece axis or lengthwise axis A by a threaded spindle or spindle member 2.

In order to axially displace the chucking device 3 by means of its threaded spindle 2 there is provided a motor drive or drive means 2' which can be controlled by a conventional control which thus need not here be further described, so that it can run quicker or slower, resulting in a quicker or slower displacement of the chucking device 3.

During the forward feed the chucking device 3 is advanced in the direction of the arrow II. By means of the chucking device 3 there is also displaced the torsion bar or rod T which is chucked therein as a workpiece or bar stock.

In order to rotate the chucking device 3 about the workpiece lengthwise axis A there is provided a gearing motor which can be controlled as concerns its rotational speed likewise by means of a known control. In this case the chucking device 3 and along therewith the torsion bar T which is chucked or clamped thereat, is rotated in the direction of the arrow 7.

In the machine frame 1 there are rotatably mounted, for instance, rolling heads 4 about the rolling head axes WA which are oriented transversely from the lengthwise axis A and spaced from the lengthwise axis A. As a matter of simplicity in illustration there are only shown two rolling heads 4, but there could also be a greater number. In each rolling head 4 there is freely rotatably mounted a respective rolling tool or element 5 so that they perform a planetary motion during revolving motion of the associated rolling head 4.

Here again it is mentioned that instead of providing only one rolling tool 5 there could also be mounted a plurality of rolling tools 5 in each rolling head 4. This has been conveniently omitted from the drawings to simplify the illustration thereof.

Each rolling head 4 is rigidly connected for rotation with a Cardan shaft 40. This Cardan shaft 40 can be driven by an associated electric motor 41 by means of a belt drive 42. In order that both of the rolling heads 4 can be synchronously oppositely driven there are provided the gears 43.

It is possible to preferably determine the feed, as indicated by the arrow II, such that the cold rolling is accomplished during pulling of the workpiece; but it is also possible to accomplish the cold rolling or forming operation during the forward feed also by pushing the workpiece opposite to the arrow II.

Independently of whether the cold rolling is accomplished during the pulling or pushing of the workpiece, the operation can be performed in counter running mode, in other words such that rolling tools 5 engage at the torsion bar T opposite to the arrow II or in the same running or travel direction of the bar stock, in other words such that the rolling tools 5 engage at the torsion bar T in the direction of the arrow II. The profile of the rolling tools 5 can be flat or concave, symmetrical or asymmetrical. They can produce, if desired, a rotational moment at the workpiece.

The torsion bar or rod T is fabricated according to the inventive method upon the apparatus depicted in FIGS. 1 and 2 in this embodiment as follows, and reference will be made with regard to the torsion bar or rod T in respect of FIG. 3 and as concerns the fabrication criteria with regard to FIG. 4:

There is chucked the torsion rod or bar T at one end or thicker parts T1 in the chucking device 3; this end or thicker part T1 has the original outer diameter TA. The torsion bar or rod is placed into rotation with the chucking device 3 in the direction of the arrow 7, during which the rotatingly driven rolling or roller heads 4, previously spaced from the torsion bar T, are slowly advanced towards the torsion bar T until the rolling tools 5, during their revolving motion, in each case approach the workpiece axis A to such an extent that the slim part T2 of the torsion bar or rod T is cold rolled. As a result the diameter TA is reduced to the diameter TJ. During the mentioned advancing movement the torsion bar T, as a general rule, is moved slower than at a later point in time in the direction of the arrow II, or such is moved in fact somewhat back and forth or in reciprocatory fashion. In any event the local machining density should not be so large that there can arise the feared drawbacks. After completion of the rolling or roller head advancing motion the axial feed of the torsion bar T in the direction of the arrow II is brought up to or fully accomplished in the inventive range or region and the cold forming or rolling operation is performed for such length of time until there has been cold rolled the required length. In so doing there is maintained a second thick end region or thicker part T1.

Now the cold rolling operation can be terminated. The rolling heads 4 are moved away from the workpiece axis A back to the starting position and the finished torsion bar or rod T is released or unchucked. The chucking device 3 is brought back into the starting position and there can be chucked and machined a further torsion rod or bar.

In the example described the following data are given by way of illustration:

The material of the torsion rod or bar was steel 42 Cr Mo 4 having a tensile strength of 800 N/mm$^2$.

TA amounted to 46.5 mm.

TJ amounted to 33.8 mm.

TD amounted to 6.35 mm.

The rolling heads 4 each contained two rolling tools 5 and were driven at 1,130 rpm.

The workpiece rotation speed amounted to 106 rpm.

The axial feed of the workpiece amounted to 760 mm per minute, so that there resulted a workpiece feed of about 6.6 mm per workpiece revolution.

In similar fashion there can be produced also a hollow torsion bar or rod which is not particularly internally profiled, and there can be used in such case sometimes even higher feed values.

In the description to follow there will be described, based upon the illustration of FIGS. 4 to 6, the fabrication of a hollow internally profiled hollow rod or bar H.

An axially displaceable chucking device or chuck 3 is also provided in FIG. 4 upon the machine frame or stand 1 corresponding basically to that shown in FIG. 1. This axially displaceable chucking device 3 is displaceable along the workpiece lengthwise axis A by a threaded spindle 2. The hollow rod or bar H is chucked in the chucking device 3 coaxially with respect to the workpiece lengthwise axis A. The threaded spindle 2 can be driven in suitable fashion by a controllable motor drive 2' in order to obtain the desired axial workpiece feed or advance, in this case in the direction of the arrow II during the first rolling operation and also there is carried out the axial return feed or movement during the second cold rolling operation opposite to the direction of the arrow II. Additionally, the chucking device or chuck 3 together with the hollow rod or bar H which is chucked upon the toothed mandrel D, can be rotated by a gearing motor 3'. As a result the hollow rod or bar H is rotated about its workpiece lengthwise axis A in the direction of the arrow 7.

At the machine frame 1 there are also rotatably mounted for rotation about axes WA disposed transversely to the workpiece lengthwise axis A two rolling heads 4 which are situated opposite one another with respect to the workpiece lengthwise axis A. Both of the rolling heads 4 are rigidly driveable in synchronization with respect to one another by a suitable conventional and thus not particularly illustrated drive so that the rolling tools or elements 5 mounted thereat always simultaneously engage at the hollow rod or bar H. For the sake of simplicity in illustration of the drawings and for ease in understanding the inventive method there have been conveniently only depicted a respective rolling tool or element 5 in each of these two rolling heads 4. Yet is to be understood that it would be possible to employ a plurality of rolling tools or elements 5 for each rolling head 4. Equally, in principle there could be provided also more than two rolling heads, as a general rule arranged opposite one another in pairs, if such is desired and possible, for instance if there is available the requisite space for this purpose.

During the first cold forming or cold rolling operation, as the same corresponds to the direction of the arrow II, it is possible to cold roll while pulling or drawing the workpiece, and then, during the second rolling operation, the cold rolling can be accomplished in a direction opposite to the arrow II while pushing the workpiece. It is of course possible to also carry out these operations in the reverse sequence.

Independent of the fact whether the cold forming or cold rolling operation is accomplished while pulling or pushing the workpiece, it is possible to work in counter direction, in other words such that the rolling tools 5 engage at the hollow rod or bar H during the first cold forming or cold working operation opposite to the direction of the arrow II or in the same direction, in other words that the rolling tools 5 engage at the hollow rod or bar H during the first rolling operation in the direction of the arrow II. It is possible to similarly cold roll or cold work in the second cold rolling operation in the return feed direction which is opposite to the arrow II. The profile of the rolling tools can be flat or concave, symmetrical or asymmetrical. If desired they can exert a rotational moment or torque upon the workpiece.

Upon this machine there can be fabricated an internally toothed shaft in the following fashion:

The tubular-shaped hollow rod or bar H is chucked at its thicker location H1 shown in the drawing, corresponding to the original diameter, in the chucking device 3 upon the toothed mandrel D and the hollow rod H is placed into rotation in the direction of the arrow 7. Equally, the rotatingly driven rolling heads 4, which previously were spaced from the hollow rod H, are slowly advanced towards the hollow rod or bar H until they have approached the workpiece lengthwise axis A to such an extent as such has been depicted in the drawings. The hollow rod H, as a general rule, is moved slower than at a later point in time in the direction of the arrow II or, in fact, it is somewhat moved back and forth or reciprocated. In any event the local machining or processing density should not be so large that there can arise the feared drawbacks. Thereafter the feed in the direction of the arrow II is completely brought up to or accomplished in the inventive range or region and the cold rolling operation is undertaken for such length of time until there has been cold rolled the required length of the workpiece W. Now there is completed the first cold rolling operation and there is undertaken the second cold rolling operation by cold rolling in analogous fashion in the axial workpiece return feed which is opposite to the direction of the arrow II and with approximately the same advance or setting of the rolling tools or elements 5. During the second rolling operation there is corrected the internal profile and the outer surface is smooth.

During the first rolling operation, in the embodiment under discussion, each tooth HZ of the internal profile is formed such that it is turned or rotated somewhat in a spiral-like configuration, and during the second cold rolling operation this turning or rotation is corrected so that each tooth of the workpiece exactly follows the correct direction, in this case extends linearly.

Of course, it is also possible to produce helically-shaped teeth.

Now the rolling heads 4 are retracted back into their starting position remote from the hollow rod or bar H and the apparatus again is located in its starting position. There is present practically no additional expenditure in relation to the single pass cold rolling because also in that case the rolling heads also must be axially moved back.

The finished hollow rod or bar H is unchucked.

A further workpiece can be chucked and correspondingly machined.

As the original workpiece there is provided a tube or tube member which possesses at its thicker location H1 which remains at the original thickness, an external diameter HA of 79 mm and an internal diameter of 63 mm. The tube consists of steel ST 52 having a tensile strength of 500 N/mm$^2$. It is drawn onto a mandrel D upon which it is reduced at the smaller size location H2 to a reduced external diameter HJ of 71.5 mm. As a result there are produced internal teeth defined by the teeth HZ and corresponding to the mandrel D. The larger internal diameter HK of the hollow space at the reduced part or region H2 amounts to 62.4 mm.

For this purpose both of the rolling heads 4, in which as previously explained there is provided in each case only one rolling tool or element 5, travels at a rotational speed of 1,450 rpm and they are advanced so slowly that the workpiece is reduced in size from its starting diameter HA to its final or finished diameter HJ, and internally thereof there is produced the tooth profile. Moreover, the hollow rod H is moved during the initial machining or cold rolling operation in the direction of the arrow II and opposite to this direction, in other words back and forth, during such time as it rotates in the direction of the arrow 7. In this example the workpiece rotational feed is maintained at 136 rpm. After the initial machining or plunge-cut operation the hollow rod or bar H is further rotated at the aforementioned speed and now is forwardly advanced or fed at 1,000 millimeters per minute, in other words, at about 7 millimeters per workpiece revolution in the direction of the arrow II. After there has been cold rolled the required length there is undertaken a reversal from the forward feed to the return feed, opposite to the direction of the arrow II, and the cold rolling operation is otherwise accomplished in the reverse feed in unaltered fashion.

There is obtained a faultless hollow shaft having cleanly aligned and cleanly formed teeth and very smooth outer surface.

Both during cold forming or cold rolling with axial forward feed in the direction of the arrow II as well as also during the second cold rolling operation with the return feed opposite to the direction of the arrow II there are performed low local machining densities, something which is attributable to the high forward feed and return feed values, here for instance 7 mm for each workpiece revolution.

The axial forward feed and the axial return feed, both of which lie appreciably above the conventional forward feed during cold rolling of teeth in solid material, prevent an excessive strengthening, turning blue, brittling and poor internal formation of the workpiece, in other words preclude the development of undesired properties. As tests have shown it would be more disadvantageous to accomplish a forward feed —or return feed slowdown below the conventional values. Only when the axial forward feed and the return feed is increased according to the invention, with comparatively constant rotational speed of the rolling heads, is it possible to achieve anywhere between improved up to extremely good results. This is so even though owing to the much lower local machining or cold working density there had to be assumed that there would be present an insufficient workpiece formation, as such is fully recognized from the experiences gained during cold forming or cold rolling of teeth in the solid.

It is once again surprising that a return feed rolling, which actually doubles the machining density, leads to a further improvement in the properties. This of course is with the prerequisite that both of the cold rolling operations are undertaken, forwardly and rearwardly, with axial workpiece feed at appreciably higher values than those conventional during cold rolling of external teeth in the solid.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A method for reducing the cross-sectional area and for calibrating the outer diameter of a solid or hollow workpiece having a lengthwise axis by cold forming, comprising the steps of:

rotatably mounting rolling tools in two rolling heads which are each rotatably driven about a rolling head axis which is transverse to the lengthwise axis of the workpiece, and wherein the rolling tools are moved in a planetary-like circulatory motion by the rolling heads;

axially displacing the workpiece during an axial feed along the lengthwise axis of the workpiece and rotating the workpiece about said lengthwise axis;

said step of rotatably mounting said rolling tools entailing the step of mounting said rolling tools for rotation exclusively about an axis extending substantially parallel to said rolling head axis;

during such axial displacement and rotation of the workpiece cold rolling the outer surface of the workpiece at least at two locations by means of the rolling tools and which locations are oppositely situated from one another with respect to the lengthwise axis of the workpiece;

during said step of cold rolling, exposing said outer surface of said workpiece to a rapid sequence of rolling tools blows at a predeterminate machining density for obtaining a predeterminate reduction in the outer diameter of the workpiece;

accomplishing the cold rolling operation such that the colding rolling operations carried out in succession at least predominantly in the direction of the lengthwise axis of the workpiece overlap in the axial direction of the workpiece and in the circumferential direction of the workpiece and bring about a displacement of material of the workpiece which is predominantly in the axial direction of the workpiece; and during said step of axially displacing the workpiece, axially displacing the workpiece at an axial workpiece feed of at least 3 millimeters for each revolution of the workpiece and thereby carrying out said cold rolling step at said predeterminate machining density in order to obtain substantially said predeterminate reduction in the outer diameter of said workpiece.

2. The method as defined in claim 1, further including the steps of:

using as the workpiece a hollow workpiece; and feeding the hollow workpiece, in relation to its machining with two rolling tools each of which revolves in one of the two rolling heads, with an axial workpiece feed of at least 5 millimeters for each revolution of the workpiece.

3. The method as defined in claim 2, further including the steps of:

mounting said hollow workpiece upon a profiled mandrel during said step of cold rolling said hollow workpiece for simultaneously forming an internal profile in said hollow workpiece;

during a first cold rolling step, axially displacing said hollow workpiece in a forward axial feed and rotating said hollow workpiece about its lengthwise axis in a predeterminate rotary direction;

during a further cold rolling step after the hollow workpiece has been cold rolled in the course of said axial feed defining a forward axial feed, axially displacing said hollow workpiece during an axial return feed of the workpiece opposite to the axial forward feed of the workpiece and rotating said hollow workpiece about its lengthwise axis in said predeterminate rotary direction;

during said axial return feed, advancing the rolling heads at most slightly more intensely towards the lengthwise axis of the hollow workpiece; and the axial return feed of the hollow workpiece selectively being about in the order of magnitude of or at most of the same order of magnitude as the preceding axial forward feed of the hollow workpiece.

4. The method as defined in claim 2, further including the steps of:

mounting said hollow workpiece upon a profiled mandrel during said step of cold rolling said hollow workpiece for simultaneously forming an internal profile in said hollow workpiece;

during a first cold rolling step, axially displacing said hollow workpiece in a forward axial feed and rotating said hollow workpiece about its lengthwise axis in a predeterminate rotary direction;

during a further cold rolling step after the hollow workpiece has been cold rolled in the course of said axial feed defining a forward axial feed, axially displacing said hollow workpiece during an axial return feed of the workpiece opposite to the axial forward feed of the workpiece and rotating said hollow workpiece about its lengthwise axis in said predeterminate rotary direction;

during said axial return feed, maintaining the setting of the rolling heads with respect to the workpiece lengthwise axis; and the axial return feed of the hollow workpiece selectively being about in the order of magnitude of or at most of the same order of magnitude as the preceding axial forward feed of the hollow workpiece.

5. The method as defined in claim 2, wherein:

said step of using said hollow workpiece entails using, as said hollow workpiece, a hollow steel tube.

6. The method as defined in claim 1, wherein:

said step of cold rolling the workpiece entails cold rolling, as said workpiece, a steel torsion bar.

* * * * *